US006702204B2

(12) United States Patent
Ivannikov et al.

(10) Patent No.: US 6,702,204 B2
(45) Date of Patent: Mar. 9, 2004

(54) CAVITATING JET

(75) Inventors: Vladimir Ivanovich Ivannikov, Moscow (RU); Ivan Vladimirovich Ivannikov, Moscow (RU)

(73) Assignee: BIP Technology, Ltd., Limassol (CY)

( * ) Notice: Subject to any disclaimer, the term of this patent is extended or adjusted under 35 U.S.C. 154(b) by 0 days.

(21) Appl. No.: 10/220,005

(22) PCT Filed: Feb. 26, 2001

(86) PCT No.: PCT/RU01/00081

§ 371 (c)(1),
(2), (4) Date: Aug. 26, 2002

(87) PCT Pub. No.: WO01/65049

PCT Pub. Date: Sep. 7, 2001

(65) Prior Publication Data

US 2003/0047622 A1 Mar. 13, 2003

(30) Foreign Application Priority Data

Mar. 1, 2000 (RU) ..... 00104952

(51) Int. Cl.[7] ..... B05B 1/26; B05B 1/30
(52) U.S. Cl. ..... 239/499; 239/600; 239/585.3
(58) Field of Search ..... 239/499, 900, 239/585.1, 585.3; 251/127

(56) References Cited

U.S. PATENT DOCUMENTS

| | | | |
|---|---|---|---|
| 3,373,752 | A | 3/1968 | Inoue |
| 3,528,704 | A | 9/1970 | Johnson, Jr. |
| 3,536,263 | A | 10/1970 | Parker |
| 3,545,552 | A | 12/1970 | Angona |
| 3,807,632 | A | 4/1974 | Johnson, Jr. |
| 3,905,553 | A | 9/1975 | Bradley et al. |
| 4,114,705 | A | 9/1978 | Milan |
| 4,187,921 | A | 2/1980 | Garner |
| 4,262,757 | A | 4/1981 | Johnson, Jr. et al. |
| 4,378,853 | A | 4/1983 | Chia et al. |
| 4,511,254 | A | 4/1985 | North et al. |
| 4,621,931 | A | 11/1986 | Jensen |
| 5,897,062 | A | 4/1999 | Enomoto et al. |
| 6,474,349 | B1 | 11/2002 | Laker |

FOREIGN PATENT DOCUMENTS

| | | |
|---|---|---|
| RU | 653435 | 3/1979 |
| RU | 1148957 | 4/1985 |
| RU | 1218117 | 3/1986 |

OTHER PUBLICATIONS

I.S. Pearsall (1972) Cavitation, Mills & Boon, Ltd, London, pp. 9–16.

R.T. Knapp et al. (1970) Cavitation, McGraw Hill Book Company, New York, pp. 13–35.

A.F. Conn et al. (1977) "Cavitating Bit Jets Promise Faster Drilling for Deep–Hole Operations", Oil and Gas Journal., 31/X, v. 75, pp. 129–146.

J.W. Daily et al. (1966) Fluid Dynamics, Addison–Wesley Ltd., Ontario, pp. 418–424.

"Oil and Gas J.", 31/X, vol 75, No. 45, pp. 129–146 Enclosed (Oct. 31, 1977).

*Primary Examiner*—Davis Hwu
(74) *Attorney, Agent, or Firm*—Collard & Roe, P.C.

(57) ABSTRACT

The invention relates to hydro mechanics and can be used for deep borehole drilling for cavitation erosion of a bottomhole, for opening-out a new productive layer for a casing pipe perforation, for bed stimulation in order to create channels for inflow pressure, for scraping out a pipe, for dispergating solid particles in a fluid and for mixing non-soluble fluids, for eliminating microbiological features from a fluid, and also in mass exchange devices and in hydrosystems for forming a cavitating fluid jet. The inventive cavitating jet comprises a body provided with a profiled flow channel and a barrier obstructing a flow. The barrier can move in a radial direction. The jet cavity is divided by a baffle into two chambers and the movable barrier at the extreme position thereof closes the flow section of one chamber. The barrier can be embodied in the form of a ball or cylinder having one or several degrees of freedom for radial displacement and closes at least 80% of the total section of the jet channel.

2 Claims, 2 Drawing Sheets

CAVITATING JET

CROSS REFERENCE TO RELATED APPLICATIONS

Applicants claim priority under 35 U.S.C. §119 of Russian Application No. 200104952 filed on Mar. 1, 2000. Applicants also claim priority under 35 U.S.C. §365 of PCT/RU01/00081 filed on Feb. 26, 2001. The international application under PCT article 21(2) was not published in English.

FIELD OF THE INVENTION

This invention relates to hydrodynamics and can be used for deep boreholes drilling, opening the productive rocks, rock treatment to create channels for fluid flowing, dispersing solid particles into liquid or mixing insoluble liquids, pipes cleaning.

PRIOR ART

Devices are known to produce regime of cavitating flow due to placing at the outlet of a nozzle of an obstacle for the flow of liquid ("Oil and Gas J.", 1977, 31/X, vol. 75, no. 45, pp. 129–146). Channel of the nozzle can be of any configuration: a narrowing one toward the nozzle exit (U.S. Pat. No. 4,378,853, publ. Apr. 5, 1983) or broadening one toward the nozzle exit (U.S. Pat. No. 5,897,062, publ. Apr. 27, 1999), one in the form of a Laval nozzle (U.S. Pat. No. 4,187,921, publ. Feb. 12, 1980), and where the obstacle can be made in a form of a rigidly fixed bar, transverse beam, curved blade, cylindrical funnel ("Oil and Gas J.", 1977, 31/X, vol. 75, no. 45, pp. 129–146), or projections into the inner space of the channel (U.S. Pat. No. 4,262,757, publ. Apr. 21, 1981).

These devices can be considered as prior art analogs in respect to the proposed invention. Main shortcomings of these devices are as follows:

1) at velocities of a liquid flow required to obtain cavitation at nozzle exit the high pressure drop takes place on the nozzle, what can be provided not in every case, especially in deep wells;
2) at high values of hydrostatic pressure, e.g. in deep wells, obtaining of cavitation using such devices is problematic.

A device is known (U.S. Pat. No. 4,511,254, publ. Nov. 10, 1981) proposing a cavitating nozzle in a drill bit. The cavitating nozzle comprises a casing body with shaped channel for flowing of a liquid and an obstacle placed into the flow. By combination of features this device is a closest prototype to the proposed invention.

Main shortcomings of this prototype are as follows:

1) high losses of hydraulic power to obtain cavitation at the nozzle exit;
2) when using a unmovable bar placed into the flow, no separation of cavitational cavity occurs and therefore cavitational effecting on a bottom hole, which is apart from the nozzle, is inefficient;
3) at high values of hydrostatic pressure in deep wells it is impossible to obtain cavitation using such devices.

DESCRIPTION OF THE INVENTION

The proposed cavitating nozzle comprises a casing body with a shaped channel for passing of a flow of liquid and an obstacle placed in the flow which obstacle is made movable in radial direction. The inner space of the nozzle can be splitted along axial direction of it by a baffle into two chambers, where the said movable obstacle, when it is in its ultimate position, closes the cross-section of one of the chambers. The obstacle can be made in the form of a ball or cylinder and to have one or more degrees of freedom of radial motion and it closes the total cross-section of the channel by not less than 80%.

Nature of features distinguishing the uniqueness of the proposed invention can be explained by the following: the obstacle that is movable in radial direction appears to be a hydrodynamic cavitator which induces separation of the decompression zone (cavitational cavity). If the obstacle in unmovable (regardless its particular design) it doesn't occur. Additionally, the cavitator made in the form of a ball or cylinder, have no equilibrium position and it automatically shifts either to ultimate right or left position as hydrodynamic pressure changes in the clearance between the cavitator and wall of the channel. In its ultimate position the cavitator closes one of the chambers formed by the baffle and thus performs a function of a valve. It allows in conditions of high hydrostatic pressure in deep wells to use kinetic energy of liquid to rupture its continuity. The movable obstacle closes the total cross-section of the channel by not less than 80%. It is determined by that at lower dimensions of cavitator it is impossible to obtain velocities of the liquid flow in the clearance between the cavitator and wall of the channel that are sufficient to produce cavitational cavities at practically available pumping rates of drill pumps.

BRIEF DESCRIPTION OF DRAWINGS

Two possible embodiments of the inventive device are shown in the FIG. 1 and FIG. 2.

Figure 1:
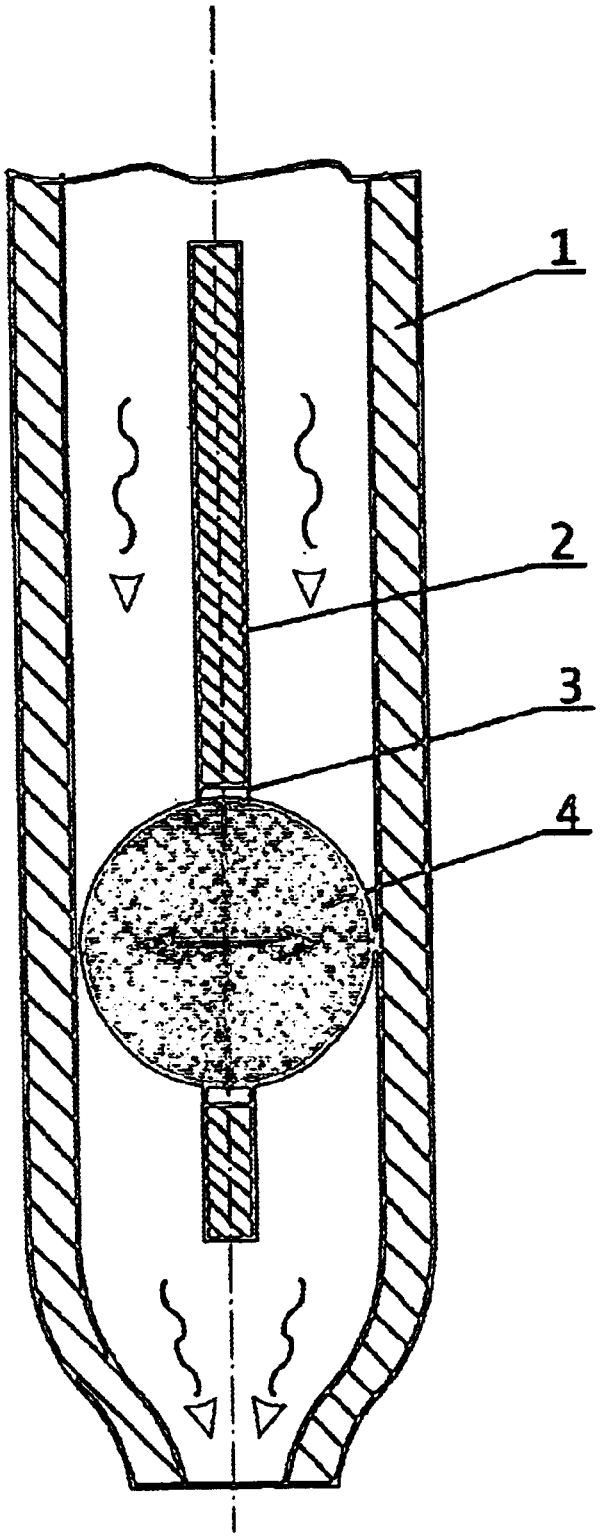
FIG. 1 shows cavitating nozzle comprising a casing body 1 in the channel of which a baffle 2 is placed having a hole 3, inside which hole a ball 4 is placed which diameter is equal to 0.8 to diameter of the inner diameter of the channel.
Figure 2:
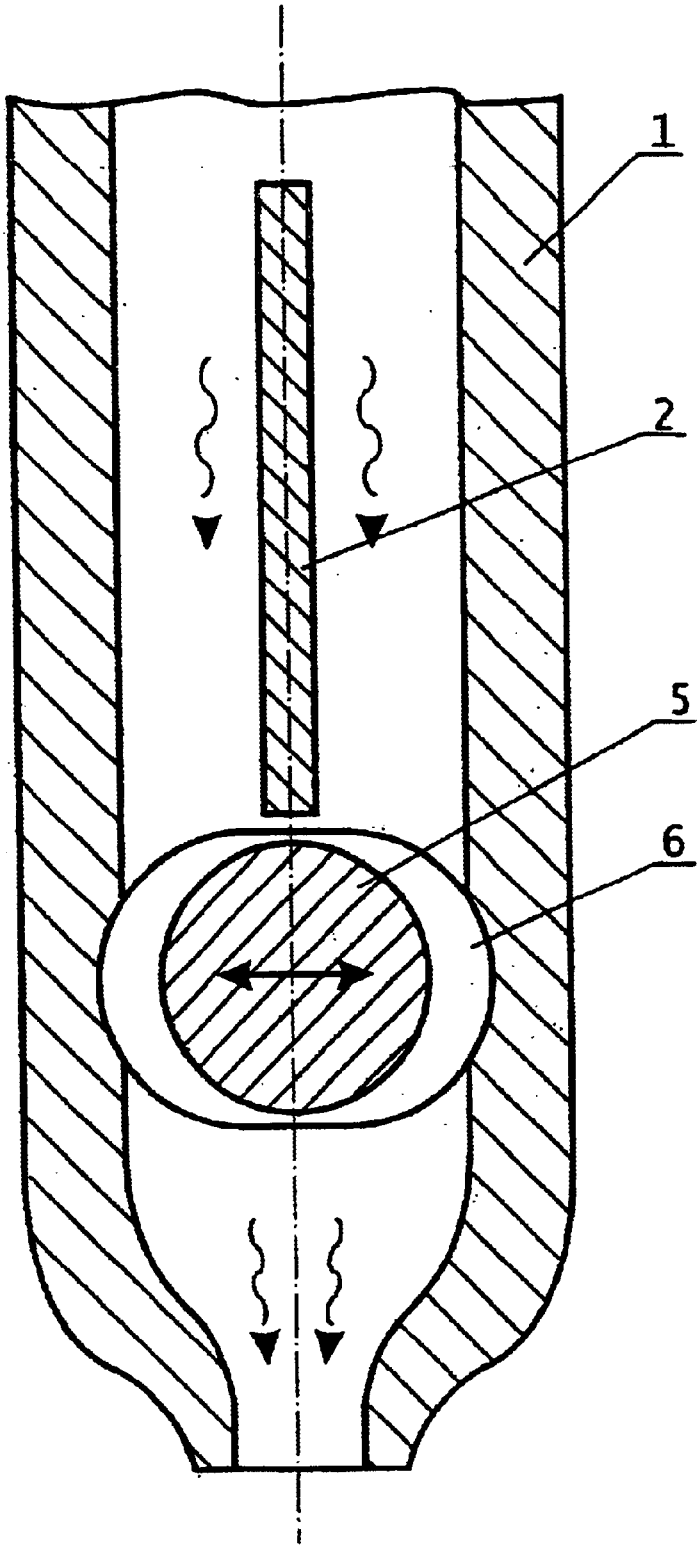
FIG. 2 shows cavitating nozzle comprising a casing body 1 in the channel of which a baffle 2 is placed and below which baffle a cylinder 5 is placed transversely to the axis, and this cylinder can radially move being supported at recesses 6 in the said body 1 and close the clearance between the cavitator and wall of the channel.

The wavy arrows show directions of the liquid flow, and direct arrows show motion of the obstacle (e.g. ball, cylinder).

The device operates as follows: liquid is pumped through the nozzle as the wavy arrows show it. As it flows around the obstacle the hydrodynamic pressure reduces in clearance between the casing body 1 and ball 2 or cylinder 5, what makes said ball 2 or cylinder 5 to move in radial direction. Once the obstacle closes one of the chambers in the nozzle channel in that chamber pressure abruptly increases while in drops in another chamber. The obstacle transfers fast into another ultimate position thus closing another chamber. Simultaneously an ejection of liquid from previously closed chamber occurs and also separation takes place of a cavitational cavity that was formed beyond the obstacle. The cavity is entrained then to the bottom hole where it implodes and performs its work. This work comprises the following: the cavitational cavity, when imploding, produces negative pressure of about 30–400 MPa what follows with a shock wave transmitting to the ambient liquid (this phenomenon is similar to a micro explosion). Thus cavitation produces breaking of materials—cavitational erosion—in case if a contact takes place of the cavitational cavities and a bottom hole.

VARIANTS OF THE INVENTION EMBODIMENTS

In scrapping-type PDC drilling bits the standard jet nozzles can be replaced with the cavitation jet nozzles.

When employed in drilling, the cavitating jet nozzles provide hydraulic resistance lower by 40–80% comparing the standard nozzles having same geometrical size of the flow channel. Moreover, according to the testing results the hydraulic resistance of the proposed nozzle does not quadratically depend on the pumping rate value. Such advantages of the cavitating jet nozzle allow to provide in a drilling bit used in deep wells the higher hydraulic power, what immediately improves drilling performances.

Work of PDC drilling bits is affected, as a rule, by clogging of the drilling bits and nozzles by a clayey material presenting at the bottom hole of the well, what requires to early lift the unworn drilling bit to clean. Use of the proposed cavitating nozzles generating high frequency vibrations of the drilling bit due to hits produced by oscillating obstacle allows to avoid sticking of the clayey particles on the bit surface and thus exclude "idle" pulls of the drilling bit. These vibrations also exclude the so-called bit balling-up which causes increasing of a torque and reduce effectiveness of transfer of weight to the bit.

APPLICABILITY IN INDUSTRY

Advantages of fluid cavitating jet nozzles of the proposed design comparing previously known ones are as follows:

1) the obstacle made in the form of a ball or cylinder movable in radial direction induces separation of cavitational cavities which are formed due to liquid flowing around it; in case of unmovable obstacle only some small bubbles are separated which then immediately implode due to action of hydrostatic pressure in a well before they reach bottom hole; the cavity after it separates from the obstacle can't implode immediately—it splits into smaller parts and due to that survives till it is entrained by flow to the bottom hole;
2) in cases when it is practically impossible to produce cavitation in wells by known practices because of the hydrostatic pressure of several hundreds of atmospheres, the proposed device produces cavitation due to employing of kinetic energy of moving liquid, and accounting the mass of the moving liquid and its speed this energy is capable to rupture the continuity of the flow despite high hydrostatic pressure in wells;
3) because of splitting of the nozzle into two chambers the cavitation is produced in the proposed invention due to employing of kinetic energy of moving liquid, and accounting the mass of the moving liquid and its speed the local liquid hammers are produced when closing the flow in a chamber and these liquid hammers result in that the flow speed in the moment of opening of the channel in chambers exceeds one in the channel upstream by up to three times;
4) due to transfer to a drill bit of vibrations generated by oscillations of movable obstacle, the friction drag of it against wall of a well is reduced thus improving drilling performances;
5) due to operation of the device in a self-sustained the consumption of energy is reduced.

These advantages allow to more effectively use a nozzle to cavitationally erode the bottom hole or productive rock when opening it by making perforations in a casing pipe; or to treat a rock to create channels in it for fluid in-flowing; or to disperse solid particles into a liquid or mix insoluble liquids, to clean pipes from a scale of various nature; to destroy microbiological objects in liquid; to employ in apparatuses for mass transfer processes or hydraulic systems to produce cavitating liquid jet.

What is claimed is:

1. Cavitating nozzle comprising a casing body with a shaped channel for passing of a flow of liquid and an obstacle placed in the flow wherein said obstacle is made movable in radial direction, wherein said movable obstacle closes the total cross-section of the channel by not less than 80% and wherein the inner space of a nozzle is split along its axial direction by a baffle into two chambers, and the said movable obstacle in its ultimate position closes the cross-section of one of the chambers.

2. Cavitating nozzle of claim 1, wherein said movable obstacle is made in the form of a ball or cylinder having one or more degrees of freedom of radial motion.

* * * * *